US012662823B2

(12) United States Patent
Smith

(10) Patent No.: US 12,662,823 B2
(45) Date of Patent: Jun. 23, 2026

(54) FLAPPER SUSPENSION SYSTEM FOR KINETIC FAÇADES

(71) Applicant: EXTECH/EXTERIOR TECHNOLOGIES, INC., Pittsburgh, PA (US)

(72) Inventor: Kevin Smith, Glenshaw, PA (US)

(73) Assignee: EXTECH/EXTERIOR TECHNOLOGIES, INC., Pittsburgh, PA (US)

( * ) Notice: Subject to any disclaimer, the term of this patent is extended or adjusted under 35 U.S.C. 154(b) by 135 days.

(21) Appl. No.: 18/887,550

(22) Filed: Sep. 17, 2024

(65) Prior Publication Data

US 2025/0215697 A1 Jul. 3, 2025

Related U.S. Application Data

(60) Provisional application No. 63/617,101, filed on Jan. 3, 2024.

(51) Int. Cl.
*E04F 13/02* (2006.01)
*E04F 13/08* (2006.01)
*E04F 13/26* (2006.01)

(52) U.S. Cl.
CPC ..... *E04F 13/26* (2013.01); *E04F 13/0826* (2013.01)

(58) Field of Classification Search
CPC ..... E04F 13/26; E04F 13/0826; E04F 13/081
See application file for complete search history.

(56) References Cited

U.S. PATENT DOCUMENTS

2015/0082921 A1 3/2015 Posner
2023/0062998 A1 * 3/2023 Smith ..... E04B 1/344

FOREIGN PATENT DOCUMENTS

RU 177234 U1 * 2/2018
WO WO-9323637 A1 * 11/1993 ..... E04F 13/0826

OTHER PUBLICATIONS

Photograph from Sochi winter olympics, circa Feb. 2014, obtainable online, www.google.com.
Posco ICT Company Ltd., System for Kinetic Wall, KIPO printout of patent registration No. 1020270510000, Sep. 24, 2019.
Extech/Exterior Technologies, Inc., Photograph of Pittsburgh's Children Museum, circa Aug. 2004, www.extechinc.com.
Extech/Exterior Technologies, Inc., internal photograph published as trademark specimen, circa Apr. 2017.

* cited by examiner

*Primary Examiner* — Patrick J Maestri
(74) *Attorney, Agent, or Firm* — McNees Wallace & Nurick LLC

(57) ABSTRACT

A façade system having moving flappers mounted using a support clip suspension system. A rung is generally triangular in cross-section having a front latitudinal slot, through which a support clip is inserted. The support clip has a pair of parallel arms connecting to each other by a transverse connecting member to be generally U-shaped. The support clip seats within the slot between the outer edge of the cap and the lower lip of the front edge, thus the flapper can be connected to the rung and held therein with the support clips secured within the slot. In the manner the flappers are hung and sway in response to wind to aid in the aesthetics of the façade.

18 Claims, 5 Drawing Sheets

FLAPPER SUSPENSION SYSTEM FOR KINETIC FAÇADES

CROSS REFERENCE TO RELATED APPLICATION

The present invention claims benefit of provisional application Ser. No. 63/617,101 filed Jan. 3, 2024, the contents of which are incorporated herein by reference.

FIELD OF THE INVENTION

The present invention relates to components of kinetic façade systems, i.e. walls which have features that move in response to influences such as mechanical systems or the environment (wind), which therefore are aesthetically pleasing. More particularly, the instant system provides a mechanism to hang the kinetic panel elements.

BACKGROUND OF THE INVENTION

Kinetic façade systems are known in the art and walls having components which respond to environmental influences have also been developed. A kinetic wall designed by applicant Extech/Exterior Technologies, Inc. is a dynamic moving building façade that creates an eye-catching aesthetic, made of a plurality of flappers. The wall responds to wind currents and undulates to create the look of rolling waves. The wall is customizable and can be designed to accommodate square or curved polycarbonate, glass, aluminum, or steel flappers. Here, the flapper elements can be dropped into framing systems or can be attached to stainless steel rods or be pin-mounted.

U.S. Patent Publication No. 20230062998 to Smith et al. and also applicant Extech/Exterior Technologies, Inc. teaches a kinetic façade system visible at night which includes a plurality of flapping panels which move in response to wind, thereby providing an aesthetic, architectural exterior. The flappers are hung on rung subassemblies. The rungs overhang each other in a stacked vertical fashion about the face of a building, each rung including a housing. An LED is disposed within the rung housing positioned near the top thereof situated on a seat to direct light upward. As such, when the flapper elements situated above the light move, the flappers swing through the light at random intervals and at varying degrees in response to the environmental conditions, thereby creating an effect at night along the façade of the building.

Again, the flappers are traditionally hung within various rungs or framing systems using pins. There is a need then for an alternative system to suspend the flapper panels of these kinetic walls.

SUMMARY OF THE INVENTION

The present invention relates generally to a kinetic façade system. The kinetic façade system can be for buildings, walls, screens or the like, which include a plurality of flapping panels, herein "kinetic elements" which move in response to wind, thereby providing an aesthetic, architectural exterior. Herein, the kinetic elements/flapper panels are mounted using a clip-like suspension system.

More particularly, the invention comprehends a façade system, comprising: a rung, the rung including a base, a front, a front edge, an interior and a top; the base and front preferably at an acute angle, joining at a lower edge; thus the front is angled downward to form the rung, in one embodiment (although not limited thereto), generally triangular in cross-section through an x-z plane; a lower screw boss at the lower edge; a rung cap having an outer edge and an inner edge for disposition over the top of the rung with a head fastener into interior proximate to inner edge; an optional gasket longitudinally along the outer edge of cap downwardly disposed; a slot having a first end and a second end of equal sectional area; the first end latitudinally defined through the front edge along the width of the rung into the interior; the first end of slot defined by the outer edge of cap and seal and a lower lip of front edge; the second end of slot defined by upper slot extrusion spaced from the front of rung; a middle screw boss adjacent to the second end generally medial along the front; the upper slot extrusion traveling between the middle screw boss and an upper screw boss; a support clip for insertion through the front edge and into the slot; the support clip having a first portion and an end portion, the first portion formed of a pair of parallel arms connecting to each other by a transverse connecting member to be generally U-shaped; the end portion formed of a pair of angled extensions; each angled extension integral to each arm; each angled extension angled downward from the respective arm to be non co-planar therewith; the end portion configured to be seated within the second end of slot between upper slot extrusion and the front; the first portion adapted to at least partially seat within the first end of slot between outer edge of cap and the lower lip of front edge; a flapper having an upper section and pair of holes defined through the upper section, the pair of holes sized to have the support clip penetrate therethrough, wherein the flapper can be connected to the rung and held therein with the support clips secured within the slot; a bushing through which each arm can penetrate such that the bushing is captured on each arm between the connecting member and the angled extension to thereby space the flapper from the front edge of the rung; a longitudinal spacer sized to be accommodated within the second end of slot to space each support clip and thereby space each flapper; optionally, a bushing or coating at the front of the rung; and, a frame, wherein each rung is attached such that the rung with flappers can be situated in a generally horizontal position within the frame secured into the frame via screws through the screw bosses.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
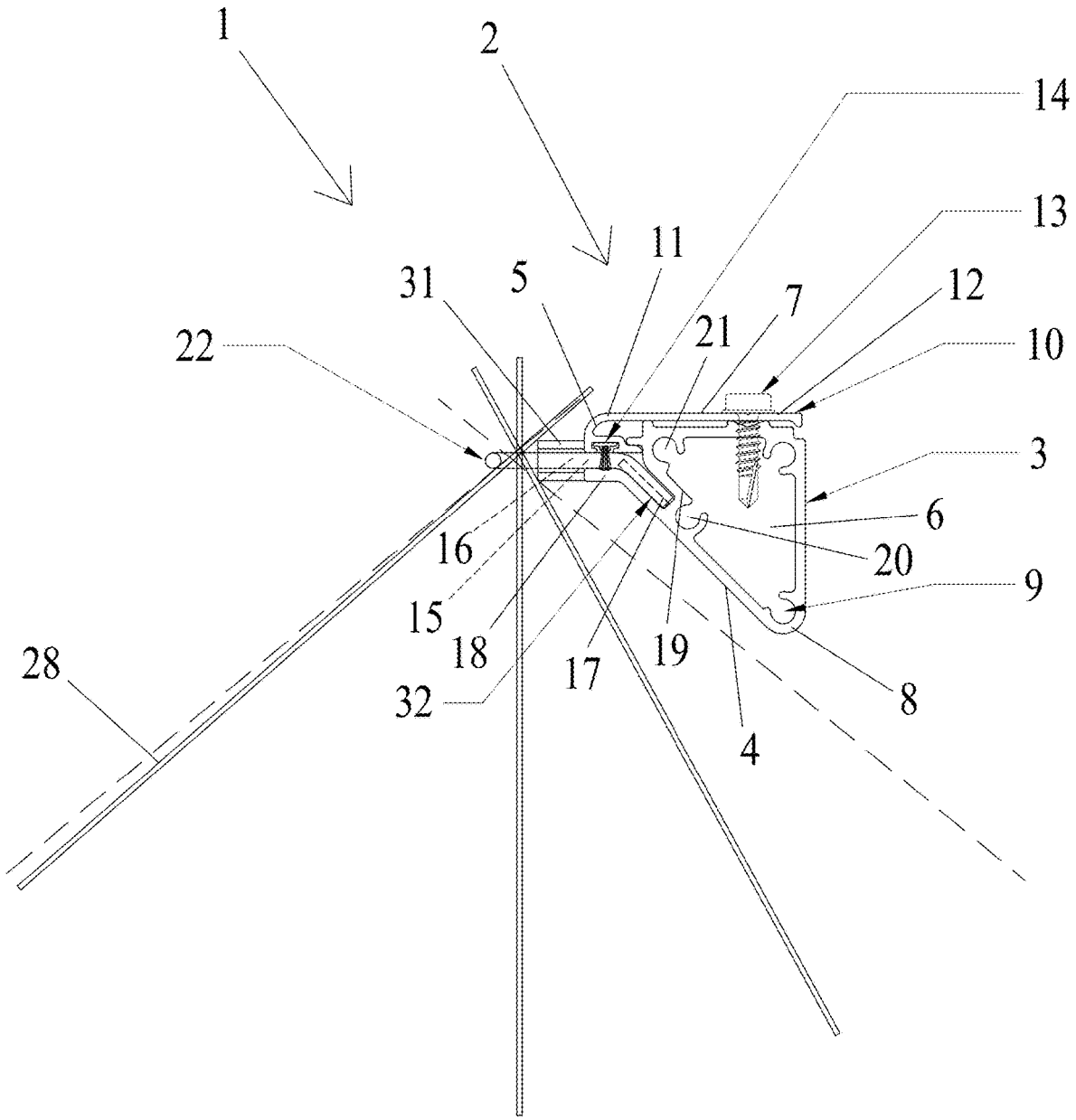
FIG. 1 shows the façade system viewed longitudinally and in cross-section through a vertical plane along one flapper and rung component.
Figure 2:
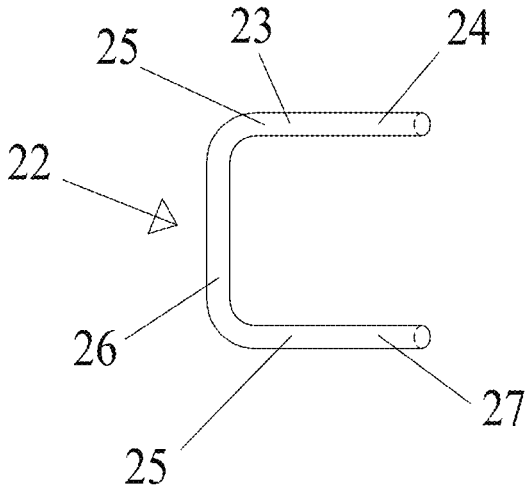
FIG. 2 shows a top elevational view of the support clip.
Figure 3:
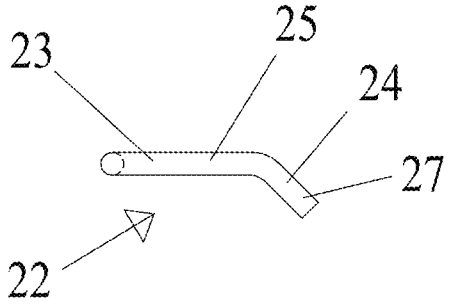
FIG. 3 shows a side elevational view of the support clip.
Figure 4:
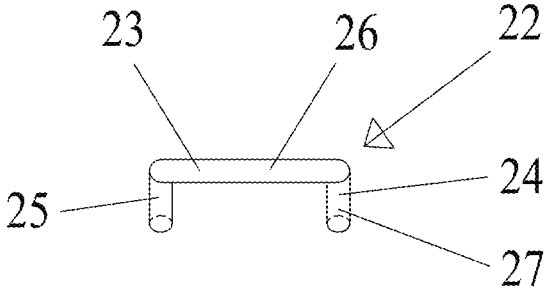
FIG. 4 shows a front view of the support clip.

Referencing then FIGS. 1-7, shown is a kinetic façade system 1. "Kinetic" here means the system is of the curtainwall type having kinetic elements designed to move. "Kinetic elements" mean a flapper or similar, thin, panel-like member. As it relates to this particular system, the movement is in response to environmental conditions such as wind, i.e., not a mechanical initiation, but rather a wind response. "Façade" means a structural wall, curtain wall, screen or any exterior supporting or non-supporting system. As a "façade system" the invention is designed in one embodiment to attach to a wall or screen, typically an exterior building wall to enhance the aesthetics of the building or screen exterior.

A first subassembly of the kinetic façade system 1 includes a rung 2. Although the exact shape of the rung 2 may vary, preferably the rung 2 is triangular in cross-section. Rung 2 includes a base 3, a front 4, a front edge 5, an interior 6 and a top 7. The front 4 and/or front edge 5 may include a bushing or coating (not shown) to account for impact or sound absorption. The base 3 and front 4 are at an acute angle, joining at a lower edge 8, thus the front 4 angles downward (i.e., relative to or "from" the top 7) to form the rung 2 generally triangular in cross-section in this embodiment through an x-z plane. Orientation designations are meant for delineation only and positioning of components can be variable. Said another way, the use of these location identifiers along the rung 2 are for lexicography only and would vary depending on orientation of the rung 2, meant here merely to distinguish. In this shape, the front 4 being angled allows for swing room of the flapper 28.

A rung cap 10 is provided, having an outer edge 11 and an inner edge 12 for disposition over the top 7 of the rung 2 with a head fastener 13 into interior 6 proximate to inner edge 12. Front edge 5 of rung 2 is defined largely by outer edge 11 of rung cap 10 but also means topmost part of front 4 should there be more integral components and no separate cap 10. An optional seal 14 can be disposed longitudinally (x-axis) along the outer edge 11 of cap 10 downwardly disposed. A lower screw boss 9 is formed at the lower edge 8 as shown. The lower screw boss 9 (and all bosses) are formed preferably from an integral extrusion extending into the interior 6 as shown. Screw boss 9 receives a screw axially (i.e. relative to x-axis of tubular rung 2) to thereby fasten rung 2 to a frame 33 (or rail end). An end extrusion (not shown) can be utilized to close off any open end.

A slot 15 is defined within the rung 2. More specifically, slot 15 has a first end 16 and a second end 17 of preferably equal sectional area, the first end 16 latitudinally defined through the front edge 5, i.e. along y-axis, or perpendicular to the longitudinal axis of the rung 2 and into the interior 6 of the rung 2 as shown. The first end 16 of slot 15 is defined by and thus closed off by the outer edge 11 of cap 10 and the combination of the seal 14 and lower lip 18 of front 4. The second end 17 of slot 15 is defined by upper slot extrusion 19, which is spaced from the front 4 of rung 2 to define this gap or slot 15 here. A middle screw boss 20 is defined adjacent to this second end 17 located generally medially along the front 4, thus the upper slot extrusion 19 travels between the middle screw boss 20 and the upper screw boss 21.

Next, a support clip 22 is provided for insertion through the front edge 5 of rung 2. The support clip 22 is inserted and removably held within the slot 15. The support clip 22 has a first portion 23 and an end portion 24, the first portion 23 formed of a pair of parallel arms 25 connecting to each other by a transverse connecting member 26 forming the support clip 22 as generally U-shaped. The support clip 22, and particularly the connecting member 26, may contain a soft resin coating (not shown) as a sound dampener. Further, the end portion 24 is formed of a pair of angled extensions 27. Each angled extension 27 is integral to each arm 25, and each angled extension 27 is angled downward from the respective arm 25 to be non co-planar therewith, i.e, deviating from the x-y plane. The end portion 24 is configured to be seated within the second end 17 of slot 15 between upper slot extrusion 19 and the front 4. The first portion 23 is adapted to at least partially seat within the first end 16 of slot 15 between outer edge 11 of cap 10 and the lower lip 18 of front edge 5 as shown.

The kinetic element of the wall is the flapper 28. Flappers 28 can vary in size and shape and be made out of a wide variety of materials like aluminum, acrylic, polycarbonate, PTFE, Kynar film, silicone sheet, rubber sheet, stainless steel, etc. The flappers 28 may vary in shape but are typically square or rectangular. The flappers 28 can be randomly spaced or spaced at equal intervals. The flapper 28 is a planar panel member having an upper section 29 and pair of holes 30 defined through the upper section 29 (off-center), the pair of holes 30 sized to have the support clip 22 penetrate therethrough, wherein the flapper 28 can be connected to the rung 2 and held therein with the support clips 22 secured within the slot 15 (see, for example, FIG. 5). The support clip 22 is inserted into the flapper 28, then into slot 15 through the front edge 5 of rung 2 as shown, to thereby be pivotably fastened to rung 2, meaning the arms 25 and support clip 22 have a diameter small enough to allow the flapper 28 to "hang" at rung 2 such that there is enough give to allow movement of the flapper 9 while concurrently the flapper 9 would maintain engagement with the rung 2. The geometry of the support clip 22 therefore is typically the same for all mounted kinetics. Such a geometry allows a forty (40) or forty-five (45) degree movement in each direction (ninety (90) total, although not meant to be limiting), hence "pivotal" attachment. Being wind-driven, the "flapping" wall provides a visual effect along the exterior of any building as the flappers 9 move. The flapper 9 can be positioned in front of the rung 2 as shown by FIG. 1, or even behind the rung 2, which may of course depend on the layout of the curtainwall.

Figure 6:
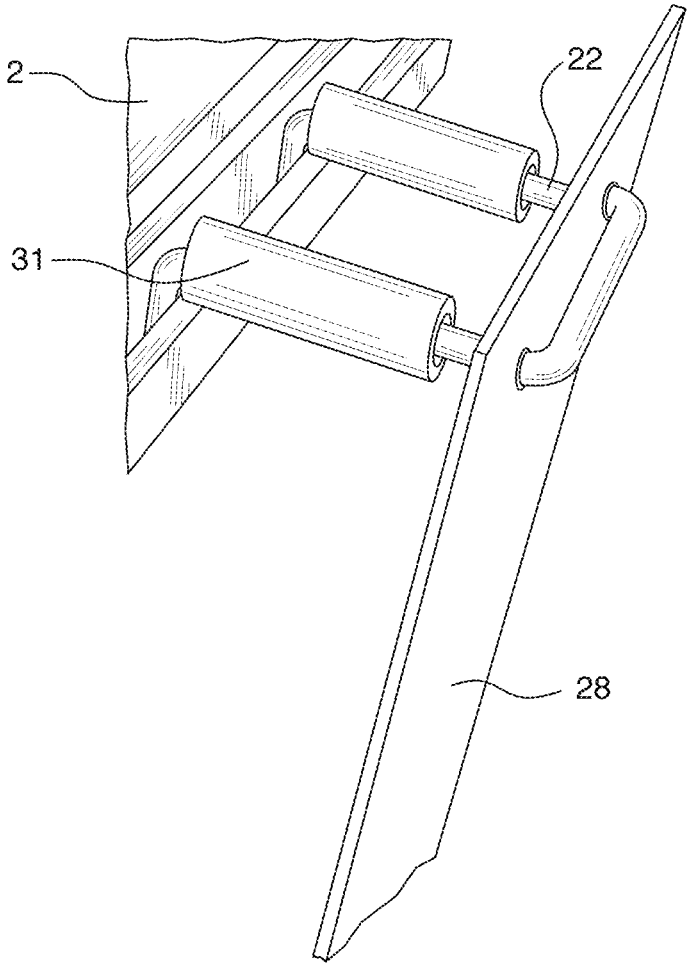
FIG. 6 shows a partial perspective view of one embodiment of the flapper connecting to the rung via the support clip.
Figure 7:
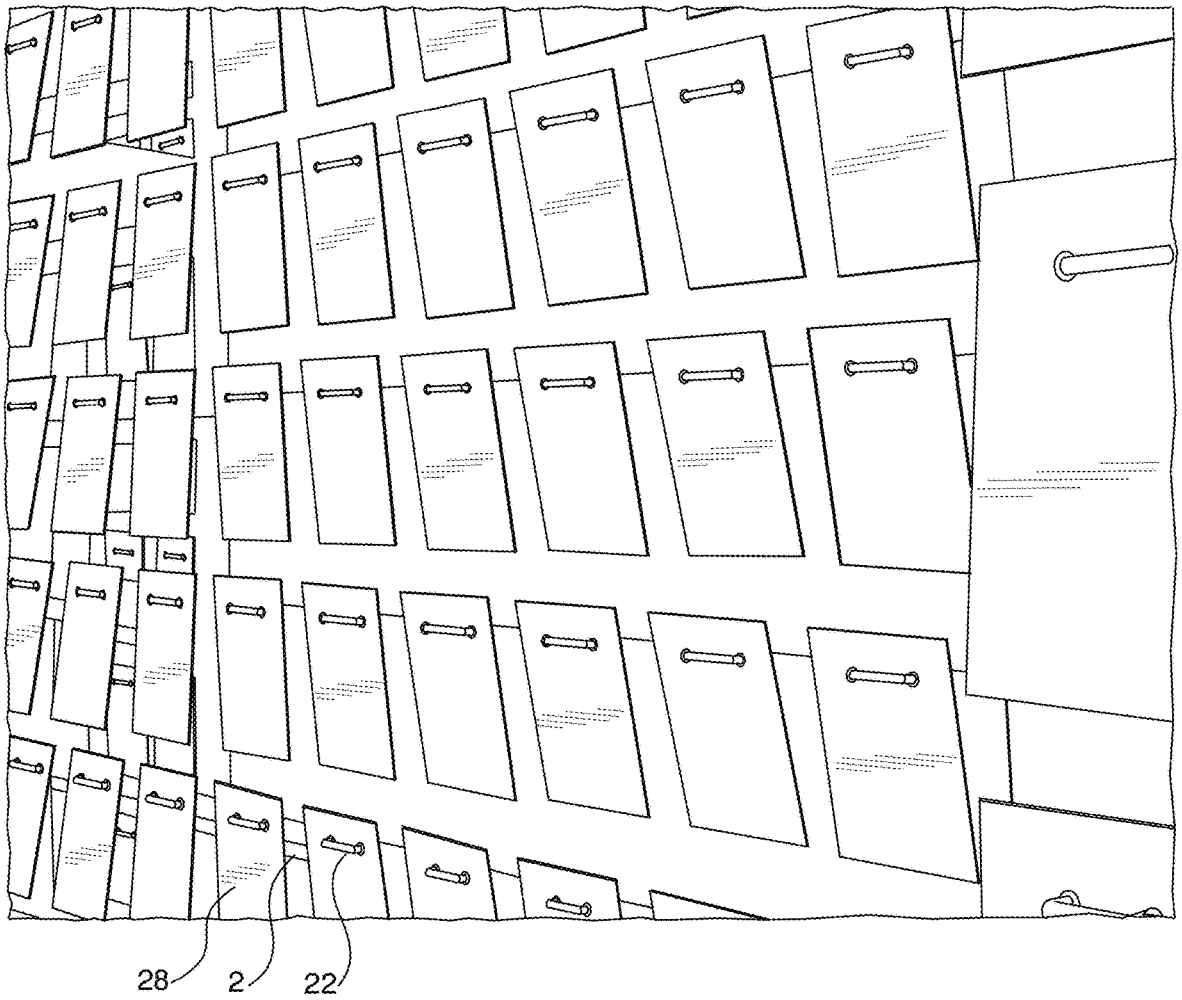
FIG. 7 shows a perspective view of a plurality of flappers and the instant façade system formed as a curtainwall.

The flapper 28 is spaced from the rung 2 by providing a tubular bushing 31 on each arm 25 through which each arm 25 can penetrate such that the bushing 31 encircles each arm 25 to thereby space the flapper 28 from the front edge 5 of the rung 2 (see FIG. 6 for detail).

Figure 5:
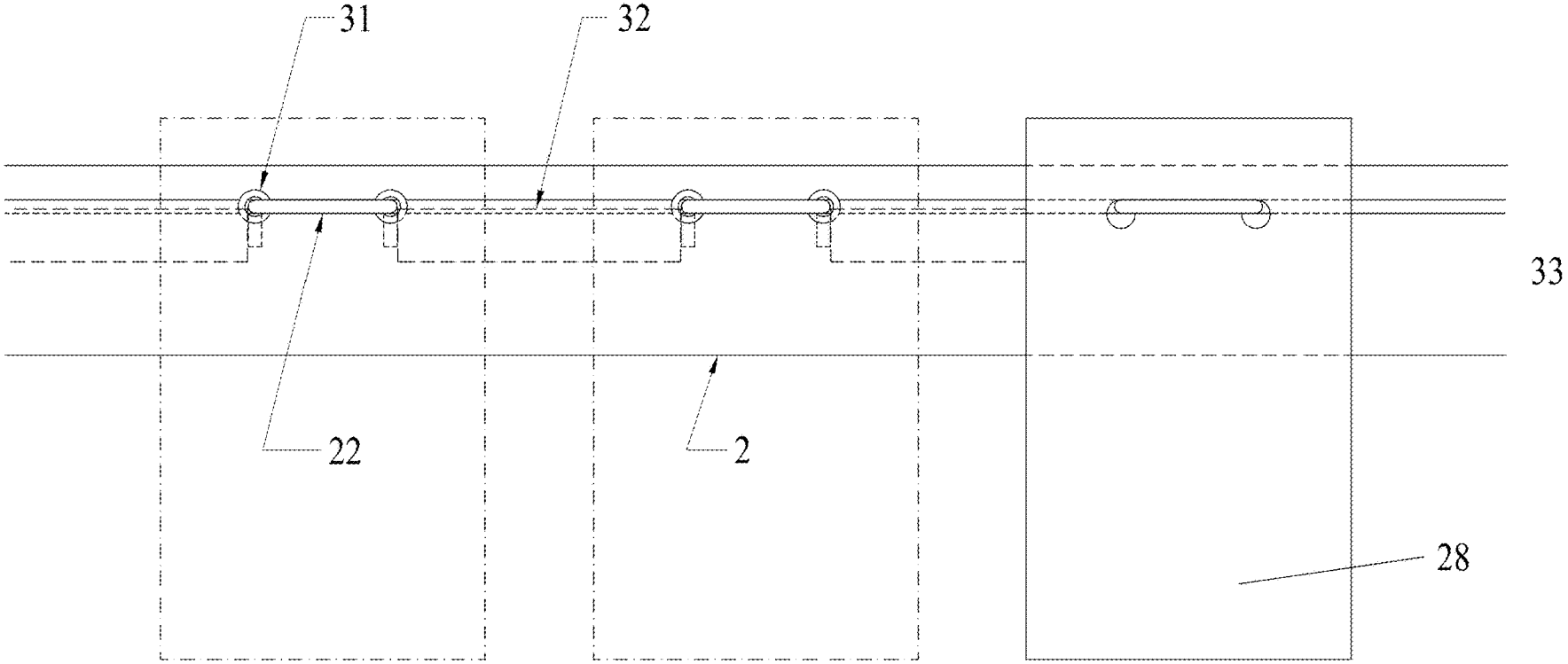
FIG. 5 shows the façade system in front elevation view along a partial length of a rung with multiple support clips and flappers.

In addition, a generally plate-like, longitudinal spacer 32 is sized to be accommodated within the second end 17 of slot 15 as shown to laterally space each support clip 22 and thereby laterally space each flapper 28 (see FIG. 1 and FIG. 5).

The rungs 2 would be typically held within a frame 33. Each rung 2 is attached such that the rung 2 with flappers 28 can be situated in a generally horizontal position within the frame 33, secured into the frame 33 via screws through the aforementioned screw bosses 9, 20, 21. Traditional curtainwall systems may include a frame 33, and potentially a plurality of extrusions which span horizontally (longitudinally) within the frame 33, anchored at each end, thus this rung 2 can be one of these extrusions. Alternatively, the frame 33 could include pre-existing, horizontal or vertical rails, each rail having a rail end (or edge) attached to the frame. As such, the rung 2 would attach to a rail instead of being a stand-alone component, so "frame" is meant to encompass any hanging, mounting or assembly means. In addition, "a" as used herein and in the claim means one or more because a curtainwall would in most instances carry multiple, or a plurality of rungs 2 which are intermittently spaced and situated in a stacked relation similar to ladder rungs. Accordingly, each rung 2 is adapted to hang in this stacked, "vertical fashion" within the frame 33 to form part of the vertical, or upstanding curtainwall.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A façade system, comprising:

a rung, said rung including a base, a front, a front edge, an interior and a top; said rung having a slot defined therein, said slot having a first end and a second end; said first end latitudinally defined through said front edge of said rung into said interior; said second end extending from said first end;

said base and said front join at an acute angle forming a lower edge with said front angled downward from said top to form said rung generally triangular in cross-section through an x-z plane;

a support clip for insertion through said front edge and into said slot; and, a flapper, said flapper adapted to be connected to said rung and held therein with said support clip penetrated therethrough and secured within said slot.

2. The façade system of claim 1, further comprising a rung cap having an outer edge and an inner edge for disposition over said top of said rung.

3. The façade system of claim 1, wherein said support clip further comprises said support clip having a first portion and an end portion, said first portion formed of a pair of parallel arms connecting to each other by a transverse connecting member, thereby forming said support clip as generally U-shaped; said end portion formed of a pair of angled extensions, each said angled extension integral to each said arm; each said angled extension is angled downward from a respective said arm to be non co-planar therewith; each said end portion configured to be seated within said second end of said slot; said first portion adapted to at least partially seat within said first end.

4. The façade system of claim 1, wherein said flapper includes an upper section and a pair of holes defined through said upper section through which said support clip can penetrate.

5. The façade system of claim 4, further comprising a bushing through which each said arm can penetrate such that said bushing encircles and is captured on each said arm.

6. The façade system of claim 1, further comprising a longitudinal spacer sized to be accommodated within said second end of said slot.

7. The façade system of claim 1, further comprising a frame system for situating said rung in a generally horizontal position.

8. A façade system, comprising:

a rung having a top, a front edge and a slot defined through said front edge;

a support clip for insertion through said front edge and into said slot; said support clip having a first portion and an end portion, said first portion formed of a pair of parallel arms connecting to each other by a transverse connecting member to thereby be generally U-shaped; said end portion formed of a pair of angled extensions, each said angled extension integral to each said arm; each said angled extension being angled downward from the respective arm to be non co-planar therewith; and, a flapper adapted to be connected to said rung and held therein with said support clip penetrated therethrough.

9. The façade system of claim 8, further comprising a rung cap having an outer edge and an inner edge for disposition over said top of said rung.

10. The façade system of claim 8, wherein said flapper includes an upper section and a pair of holes defined through said upper section through which said support clip can penetrate.

11. The façade system of claim 8, further comprising a bushing through which each said arm can penetrate such that said bushing encircles and is captured on each said arm between said connecting member and each said angled extension to thereby space said flapper from said front edge of said rung.

12. The façade system of claim 1, further comprising a longitudinal spacer sized to be accommodated within said slot.

13. The façade system of claim 1, wherein said connecting member is coated with a resin.

14. A façade system, comprising:

one or more rungs, each said rung further comprising:

a base, a front, a front edge, an interior and a top; said base and said front at an acute angle, joining at a lower edge; said front angled downward to form said rung generally triangular in cross-section through an x-z plane;

a lower screw boss at said lower edge;

a rung cap having an outer edge and an inner edge, said rung cap for disposition over said top of said rung;

a slot, said slot having a first end and a second end and said slot latitudinally defined through said front edge into said interior; said second end of equal sectional area to said first end and said second end defined by an upper slot extrusion within said interior, said upper slot extrusion generally parallel to said front to define said second end;

a middle screw boss adjacent to said second end positioned generally medial along said front, wherein said upper slot extrusion terminates at said middle screw boss;

an upper screw boss above said upper slot extrusion below said top; and, a frame system, wherein each said rung is attached to said frame system such that the rung can be situated in a generally horizontal position to receive a flapper.

15. The façade system of claim 14, further comprising:

a support clip for insertion through said front edge and into said slot; said support clip having a first portion and an end portion, said first portion formed of a pair of parallel arms connecting to each other by a transverse connecting member such that said first portion is generally U-shaped; said end portion formed of a pair of angled extensions, each said angled extension integral to each said arm; each said angled extension is angled downward from the respective arm to be non co-planar therewith; said end portion configured to be seated within said second end of said slot between said upper slot extrusion and said front.

16. The façade system of claim 15, further comprising:

said flapper having an upper section and pair of holes defined through said upper section, said pair of holes sized to have said support clip penetrate therethrough, wherein said flapper can be connected to said rung and held therein with said support clips secured within said slot.

17. The façade system of claim 15, further comprising a bushing through which each said arm can penetrate such that said bushing encircles and is captured on each said arm between said connecting member and each said angled extension to thereby space said flapper from said front edge of said rung.

18. The façade system of claim 14, further comprising a longitudinal spacer sized to be accommodated within said slot.

* * * * *